United States Patent [19]

Gabillard

[11] 3,953,714

[45] Apr. 27, 1976

[54] METHOD OF AND MEANS FOR CONTROLLING THE MOVEMENT OF SELF-PROPELLED BODIES TRAVELING IN A FIXED ORDER ALONG A TRACK

[75] Inventor: Robert Gabillard, Lille, France

[73] Assignee: Agence Nationale de Valorisation de la Recherche (ANVAR), Courbevoie, France

[22] Filed: Dec. 5, 1974

[21] Appl. No.: 529,941

Related U.S. Application Data

[63] Continuation of Ser. No. 291,406, Sept. 22, 1972, abandoned.

[52] U.S. Cl. ..... 235/150.2; 235/150.24; 246/182 B; 246/187 B

[51] Int. Cl.[2] ..... G06F 15/48

[58] Field of Search ..... 235/150.2, 150.24, 92 TC; 246/182 A, 182 B, 182 C, 187 R, 187 B, 187 C; 340/32, 47, 48

[56] References Cited

UNITED STATES PATENTS

| | | | |
|---|---|---|---|
| 3,240,929 | 3/1966 | Hughson | 235/150.2 X |
| 3,268,727 | 8/1966 | Shephard | 235/150.24 UX |
| 3,334,224 | 8/1967 | Allen et al. | 246/182 B X |
| 3,440,600 | 4/1969 | Frech et al. | 235/150.24 X |
| 3,604,905 | 9/1971 | Riondel | 235/150.24 |
| 3,731,088 | 5/1973 | Grundy et al. | 246/182 B |

*Primary Examiner*—Malcolm A. Morrison
*Assistant Examiner*—Jerry Smith
*Attorney, Agent, or Firm*—Ernest G. Montague; Karl F. Ross; Herbert Dubno

[57] ABSTRACT

A method and device for facilitating the movement of a number of moving bodies such as trains travelling behind each other in a closed circuit with all the necessary automatic functions such as safety precautions against collision and control of traffic, is arranged by providing an ideal circulation of imaginary moving bodies corresponding to the actual bodies and progressing regularly according to a pre-established programme, each actual moving body being constrained to remain, within limits behind its corresponding imaginary moving body taking into account possible braking requirements, and, in front of the imaginary moving body controlling the next actual moving body. Means are provided for stopping the imaginary moving bodies and consequently the actual moving bodies in the case of mishaps, all the functions being effected with simple passive reference marks located along the line and spaced apart in such a way that the time taken by imaginary moving bodies to cover the distance separating two successive reference marks is always a substantially constant time.

26 Claims, 5 Drawing Figures

METHOD OF AND MEANS FOR CONTROLLING THE MOVEMENT OF SELF-PROPELLED BODIES TRAVELING IN A FIXED ORDER ALONG A TRACK

This is a continuation of application Ser. No. 291,408, filed Sept. 22, 1972.

This invention relates to a method of and means for facilitating the movement of a number of self-propelled bodies traveling in a fixed order on one line in a closed circuit.

The method is designed to perform simultaneously all the necessary automatic functions such as safety precautions to prevent collisions and to control the traffic.

The method according to my invention provides a simulated circulation of imaginary moving bodies according to a pre-established program by compelling each self-propelled body to remain behind the imaginary moving body controlling it and in front of the imaginary moving body controlling the next self-propelled body, means being provided for stopping these imaginary moving bodies in the case of mishaps. All these operations are effected without a computer or telecommunication means between the moving bodies and require between all the moving bodies and a fixed station only one telecommunication means using only two carrier frequencies.

This applies in particular to public transport systems as well as to conveyors and transporters.

My invention also relates to a device which makes it possible to carry out this method.

The current development of techniques for running urban transport lines tends more and more towards automation of the operations which were previously carried out by human operators.

The nature of these operations is analyzed hereinafter.

If the personnel responsible for the commercial running of the line is disregarded, there remain only the drivers on board the trains and the persons on the ground responsible for controlling the line.

The functions of the drivers are:

a. To drive the trains, i.e. to start them; to continuously control their speed according to an operating program which respects the speed limit at each point of the track and, if it is followed correctly, makes it possible to keep to a timetable and finally to stop them at the stations at a precise point.

b. To insure safety, i.e. to avoid any collisions with a train located in front.

The functions of the control staff are essentially to make constantly the necessary decisions for redirecting the trains in transit towards their theoretical positions defined by the timetable if any incident interferes with their movements.

For an urban transport line which is in the form of a loop, divided into "sections" by light or electric signaling units, through which there pass a regular succession of trains, all identical, the causes of disruption emanate mainly from the passengers. If at one station the passengers take too long to board a train, the latter becomes delayed and at the subsequent station there is a greater number of passengers to board which takes even longer. The process is thus unstable and the distance between the delayed train and the preceding one increases.

If this phenomenon is allowed to develop, the delayed train blocks all the following ones and all the trains accumulate behind it so that there is one train in each successive section; since the several signaling sections are short, the trains form a tightly packed bunch and the system can no longer operate with satisfactory handling of passengers.

In the current state of the art the control operation requires a very complex telecommunication system, between a central control station, the line network and the trains traveling thereon.

As can be seen from a publication by Mr. J. MAJOU: "Conceptions actuelles du Metropolitain de PARIS en matiere de commande centralisee du trafic" (R.G.E. February 1969, pages 141 to 145), in the system used by the R.A.T.P. (Rapid-Transit System of Paris) on line No. 1, the position of the trains is known at a central station by virtue of the transmission of the signals of occupation of all the signaling sections. Depending on the facts, a computer determines the ideal departure times for each train at each station. It transmits these commands to the drivers of the trains by a special signal placed ahead of the stations.

The computer can thus inform each driver as to the magnitude of his delay (which enables the latter to attempt to make it up by traveling at a higher speed), and also to keep the trains which precede a delayed train for a longer period of time at the station in order to prevent bunching.

The disadvantage of this system is that it is only possible to know the position of each train relative to the length of a section and to act on the trains as they leave the stations.

Examples of more elaborate systems can be found in the literature.

In particular the following works are referred to: Messrs. A. LEMAIRE, H. AUTRUFFE, R. QUONTEN: "Système de régulation automatique des trains en zone à trafic dense" (Synp. Intern. Sur la régulation du trafic IFAC/IFIP, Versailles, 1 to 5 June 1970).

Messrs. R. BLAISE and C. JONQUET: "Exemple d'application de l'informatique au contrôle de la marche des trains" (1$^{er}$ Symp. Intern. Sur la régulation du trafic IFAC/IFIP, Versailles, 1 to 5 June 1970).

Mr. H. J. HAHN: "Application of automation to railway operation" (The Railway Gazette, Jan. 15, 1965).

Mr. SCHNORR: "Automation of railway traffic operational requirements and technical possibilities" (Document BROWN-BOVERI, 3070E).

Messrs. J. W. BROWNSON and G. M. THORNE-BOOTH: "Strategic control of the San Francisco Bay area rapid transit system" (joint IEEE-ASME Railroad Conf., Montreal, Apr. 15, 1969).

Mr. T. R. GIBSON: "BART central control" (Ann. Meetg. of the Association of American Railroads, Montreal, Sept. 17, 1969).

In these systems a telecommunication by waveguide enables each train to continuously transmit its position and speed to a central computer. The computer, which is thus continuously informed of the state of the succession of trains, transmits to each train the speed at which it should be traveling at each instant in order that the control operation be effective for the entire line.

It should be noted that a system of this type also facilitates the automatic driving of the trains. Indeed the computer, permanently informed of the progress of each of the trains and carrying in its memory the operating program for the section of track between any two stations, can work out and transmit to each train the necessary orders for insuring its control.

These systems have to their advantage very great flexibility, but their disadvantages are their very high cost and complexity. In fact the transmissions must be selective from each train to the central computer and from the computer to each train and they must operate despite the very high level of interference on an electrified transport line. These two conditions are not easy to obtain and the maintenance cost of such a system is very high.

Finally these systems are very delicate, any stoppage of the central computer causing a complete paralysis of the system. Thus a secondary computer is generally provided which is able to come into operation if the first should break down, which considerably increases the cost of the system.

Other, less ambitious systems are content to measure the speed of each train as it passes certain fixed points on the track and to transmit the operating commands to the train at these same fixed points. Since the trains always pass by in the same order, it is not necessary to provide a selective transmission from each train to the transmit/receive posts installed at the fixed points. But this system has the disadvantage of requiring the installation of delicate instruments at a large number of points along the track and of having to connect each of these devices individually or selectively to the central computer. There are also the same transmission difficulties created by the high level of interference, and the system is equally vulnerable to a breakdown of its computer.

In order to avoid the use of a central computer, several systems are content with automating only the "drive" operation by means of devices mounted on board the trains.

This has been disclosed in the following works:

Mr. J. P. PERRIN: "Pilotage automatique sur le reseau metropolitain de PARIS" (Automatisme, tome XV, No. 5, May 1970, pages 210–214).

Mr. D. SUTTON: "Développement et perspectives de l'expérience de pilotage automatique sur les rames du Métropolitain de PARIS" (R.G.E. February 1969, pages 135–140).

The R.A.T.P. has equipped trains on the No. 4 line with an automatic pilot which operates in the following manner:

A wire carrying alternating current is arranged along the track in the manner of a grid. On board the trains a magnetic-field detector detects the instant at which they pass over the successive stages of the grid. The lengths of the stages of the grid are calculated in order that a train, which is traveling at exactly the theoretical speed provided by the operating program, uses the same time To to cover each stage. An electronic device measures the time T that the train actually uses to cover one stage. If T is greater than To the train is accelerated; in the opposite case the train is decelerated.

This device has several embodiments which differ mainly in the manner in which the successive stages are formed and the times T and To are compared.

In the most recent version, stages are constituted by breaks in the laying of a wire which runs along the track and the reference time To is defined as being a given multiple of the period of the alternating current carried by the wire. The possibility thus exists, by changing the frequency of the current, of altering the traveling speed of the trains on the section of line where the wire is located.

In contrast to the R.A.T.P. system where the running program is constituted by the stages of a wire located along the track, the S.N.C.F. (French National Railroad System) has developed an automatic driving system (disclosed in a publication of Messrs. A. LEMAIRE and H. AUTRUFFE, "Processus automatisé de circulation et régulation des trains dans un systeme hétérogène pour accroitre le debit es lignes", Etudes et expériences en cours à la S.N.C.F. — Document S.N.C.F.), where the running program is inscribed on a perforated tape which unwinds on board the train in proportion to the distance covered. The distance is measured by counting the number of revolutions of the wheels and by correcting this measurement (which may be altered by skidding of the wheels) when passing any signal-contact ramp.

In the R.A.T.P. driving system, stopping at a station is obtained at the approach to the station by decreasing the length of the successive stages of wire according to the law of arithmetic progression. This law is calculated so as to brake the trains to a very precise stop.

In the S.N.C.F. system a magnetic beacon is placed at a certain distance before the station. This beacon initiates a special braking program which controls in a very accurate manner the decrease in speed depending on the distance covered since passing the beacon (by counting the number of revolutions of the wheels) in order to stop the train at an exact point in the station.

The disadvantage of the automatic control systems of the R.A.T.P. and S.N.C.F. is that they necessitate the provision of active elements along the track: wires carrying current which must be arranged in a very precise manner, or magnetic beacons.

Finally, neither of the automatic control systems at present utilized by the R.A.T.P. and S.N.C.F. insures safety against collision.

This safeguard is available with standard sectional signaling systems wherein the automatic pilot device only intervenes to cause the stopping of the train in front of a red signal. This stopping is achieved in the R.A.T.P. system by placing two wires upstream of the signal, one of these wires being energized if the signal is green, the other if the signal is red. The first wire is provided with regular stages which allow the train to pass the signal without slowing down; the other is provided with stages of decreasing length which cause the train to stop as if it were stopping at a station.

The S.N.C.F. system is not provided with means for the automatic stopping of trains in front of a red signal but such stopping could be accomplished by a beason placed a good distance in front of the signal for initiating a braking action if the signal is red.

Finally, none of the automatic drive systems insures effective control of train traffic on the transport lines. This control requires the presence of drivers on board the trains.

There are very few examples of transport systems where the trains circulate automatically without drivers on board. One of these examples is provided by the train at the Montreal exhibition park, constructed by the Swiss firm HABBEGGER, details of which are described in the works of:

Messrs. E. ALZINGER and F. KRONIG, "L'entraînement électrique et la commande des trains - Mini rails" (Revue BROWN-BOVERI, No. 3, 1969);

Mr. C. HONEGGER, "Einrichtung zur automatischen Steuerung des gegenseitigen Abstandes von Fahrzeugen" (Swiss Pat. No. 397761, Mar. 15, 1963).

The automation of these trains insures only the essential function of anti-collision safety, and stopping at a station is obtained by simulating the presence of a train downstream of the station. The anti-collision safety is realized by measuring the distance from one train to the preceding one. The HABBEGGER device uses for this purpose a special rail formed of segments approximately 7 meters long insulated electrically from the ground and from one another. They are interconnected by Zener diodes, electric components which have the property of keeping a constant voltage between their terminals whatever the intensity of current passing through them.

At the front of the train a shoe sends current into this rail. This current returns to ground at the track by the intermediary of another shoe which grounds the rail and is located at the rear of the preceding train. The voltage E existing between the shoe of the first train and ground will thus be equal to nE, *n* being the number of diodes existing between the current-injection shoe and the grounding shoe. Since the diodes are separated by segments of rail of known length, E is a measurement of the distance separating the train from the preceding train.

The HABBEGGER system is thus a solution of the "moving section" type. In fact it does not measure the distance between the two trains continuously but does so with an uncertainty equal at most to twice the length of a segment.

Its disadvantage is that it requires the use of shoes and the installation of a special rail and of numerous housings containing the Zener diodes connected by wires to these rails and requiring careful maintenance.

The present invention, which obviates all the abovementioned drawbacks, simultaneously carries out all the necessary automatic functions such as driving, safety against collisions and traffic control of trains or other vehicles for the transportation of passengers or, more generally, self-propelled bodies circulating in a closed loop always in the same order and in the same direction, this being accomplished by the simulated circulation of the aforementioned imaginary bodies with intermittent stops. The self-propelled body associated with each imaginary body is compelled to remain between two successive imaginary bodies, means being provided for stopping the imaginary bodies and consequently the self-propelled bodies in the case of an accident. The drive of the mobile bodies is controlled with the aid of simple passive reference marks located along the line and spaced apart in such a manner that the time taken by the imaginary bodies to cover the distance separating two successive reference marks is generally constant.

My invention will now be described by way of example with reference to the control of passenger vehicles or trains but may be utilized with any other type of mobile body.

Each real vehicle (train or other self-propelled body) is caused to pass at each reference mark of the track into a temporal buffer zone defined by the instants at which two successive imaginary vehicles pass the same reference mark; in the case of any mishap involving a real vehicle, an alarm device stops the succession of imaginary vehicles, and therefore of the associated real vehicles, so as to make a collision between the two real vehicles impossible. The relative distance between a real vehicle and the preceding vehicle associated with it is maintained within a range taking into account the braking distance of the real vehicle, this relative distance depending on the speed of the real vehicle.

Each real vehicle causes the stopping of the succession of imaginary vehicles if, for any reason, it is in danger of being caught up with by the imaginary vehicle associated with the following real vehicle.

The speed of the real vehicles is limited on the basis of a measurement of the time which it takes each real vehicle to pass between successive reference marks on its track. The track is provided with transmission means, which may be a single wire arranged along the track, serving to transmit a drive-actuating signal of constant frequency from a stationary transmitter to each of the real vehicles and designed to control on board each real vehicle the advance of the imaginary vehicle associated therewith. The line is further provided with suitably spaced reference marks which may be entirely passive and are sensed by detectors on the real vehicles whenever the latter pass one of these reference marks, thereby producing marker pulses serving the real vehicle as references for its position along the line and, consequently, for representing its distance relative to the imaginary vehicle which is associated with it.

The drive-actuating signal picked up on board each vehicle is of constant frequency and serves to produce isochronous-timing pulses which are added up either by a first counter ascertaining the position of the imaginary vehicle or by a second counter measuring its stopping time, use of one or the other counter depending on the position of a switchover circuit which is actuated by a programmer when one or the other of the two counters reaches a preselected number so chosen that the imaginary vehicle stops after having covered a predetermined distance from its last stopping point on the track and restarts after having been stationary for a certain waiting period; the successive distances traveled and the stopping times may vary greatly in the course of one transition of the imaginary vehicle along the track.

The presence of a calculator including a subtracting device makes it possible to calculate the difference between the number of timing pulses added up in the first counter of the imaginary vehicle (determining the instantaneous position) and the number of marker pulses added up in a third counter (determining the position of the real vehicle) which is stepped when the real vehicle passes a reference mark on the track, the reading of the first counter being transmitted to the subtracting device by way of a timing-pulse memory whose function is to allow the real vehicle to halt at a prescribed stopping point even if its associated imaginary vehicle has already left there. The output of the subtracting device reaches a comparator acting on the brake or on the motor of the real vehicle, depending on whether the output of that subtracting device is smaller or greater than the output number of a numerical speedometer measuring the speed of the real vehicle in conventional manner.

The marker-pulse counter is associated with a set of comparators generating a halt signal when the real vehicle arrives at a prescribed stopping point, this signal serving to cause the opening of the doors of the real vehicle and any other action which this vehicle must carry out at a station. The halt signal also triggers on automatic timing device which, after a predetermined period of time, unblocks the timing-pulse memory which had been blocked at the time of the arrival of the associated imaginary vehicle at the station, this unblocking action allowing the real vehicle to depart.

The drive-actuating signal of constant frequency picked up on board each real vehicle is transformed into a feedback signal of different frequency which is transmitted from each real vehicle to a stationary receiver, via the common transmission line, during a predetermined period from the moment of the beginning of the emission of the time-actuating signal, this transmission period being different for each of the real vehicles circulating on the track. The several transmission periods are so interrelated that the stationary receiver detects a continuous signal in the course of a monitoring cycle if all the transmitters of the real vehicles are operating, and detects an interrupted signal during such cycle if at least one of the vehicular transmitters is not operating; the emission of the drive-actuating signal by the stationary transmitter is interrupted for a monitoring cycle, which is equal to the sum of all the aforementioned transmission periods, and resumes thereafter whenever the stationary receiver detects another feedback signal.

The timing pulses which serve to advance the imaginary vehicles are generated only in the presence of the normally continuous drive-actating signal whose interruption could be caused only by the stoppage of the emission of the feedback signal when any one of the real vehicles does not transmit in the period allocated to it.

The presence on board each real vehicle of a second subtracting device makes it possible to calculate the difference between the sum of the instantaneous counts of the first and second counters, which determine the simulated progress of the imaginary vehicle, and the reading of the marker-pulse counter determining the position of the real vehicle, this difference being compared with a number representative of safety distance which must separate the real vehicle from the imaginary vehicle associated with the next-following real vehicle. This comparison is carried out continuously by a comparator which inhibits the transmission of the feedback signal from the real vehicle whenever the output of the subtracting device becomes less than the number representing the safety distance. Thus the relative distance between the real vehicle and its associated imaginary vehicle is determined by the relative magnitudes of the readings of the three counters referred to.

According to another feature of my invention, each real vehicle is provided with an odometer generating a pulse whenever the vehicle has progressed by a predetermined distance; a comparator constantly compares the number of pulses generated by the odometer during a given measuring period, accumulated in a fourth counter and an associated memory, with the number of pulses (or a certain fraction thereof) generated by the odometer during the movement of the vehicle between two successive reference marks on the track, accumulated in a fifth counter also provided with a memory, this comparator limiting the speed of the real vehicle by cutting off its motor and thereafter actuating its brakes if the number of pulses registered by the fourth counter during a measuring period matches and then exceeds the number of pulses added up by the fifth counter.

Each real vehicle which is delayed may exceed the speed of the imaginary vehicle which is associated with it in order to make up the delay which separates it from its imaginary vehicle. This higher speed may be decreased in the dangerous regions of the line by supervisory means responsive to specially positioned supplemental reference marks along the line, but may be immediately re-established beyond the dangerous regions by the action of further supplemental reference marks on the supervisory means.

The marker pulses coming from the reference-mark detector aboard each vehicle are registered by the third counter only if they are generated by normal reference marks separated by a distance greater than a given value; supplemental reference marks, spaced by a distance less than this value from a preceding mark, give rise to a special signal used for first decreasing and then restoring to its normal value the maximum speed of the vehicle, particularly at the entrance of and exit from dangerous regions, by actuating the aforementioned supervisory means to modify the measuring period referred to.

My present invention thus constitutes a very substantial improvement with respect to the prior art in the sense of simplicity and integration into a single system of the various means relating to automatic drive, safety and control.

With particular reference to passenger vehicles, the system according to my invention only requires the installation along the track of a single wire placed in any position and without any special precautions along the roadbed, as well as the provision of entirely passive reference marks, one example of which may be simple metallic angle irons screwed at predetermined points to certain sleepers on the track. The following description relates to a standard railway track; it is obvious that the simplicity remains the same in other instances as, for example, with concrete roadways and vehicles traveling on tires. There is no need for high-frequency waveguides, coaxial or telephone cables, or any other telecommunication link between a central point, the stations and the trains, apart from the single wire already mentioned which may be considered as a simplified waveguide.

My invention does not require the use of a complex computer either at a fixed point or on board the trains. No electronic or electric device needs to be installed along the track.

Moreover, anti-collision safety is obtained without the need for dividing the track into separate sections by means of signals or control devices, or for establishing electric contact with the rails (which involves shoes in the case of tire-supported trains), and without the installation of a signaling system along the track. My system also dispenses with the use of any physical device on board the trains for a measurement of the distance separating each train from the preceding one.

Despite this simplicity, which also makes it possible to carry out the invention at relatively very low cost, the following functions are performed:

The trains or vehicles leave the stations automatically after a prescribed stopping period and after the doors have been closed. This stopping time may differ from one station to another and can be easily changed. It may be shorter if the train is delayed.

Between stations, as the train travels along, it respects the speed limits at each point of the track. On straight lines the trains travel more quickly if they have been delayed at the previous station by a rush of passengers preventing the closure of the doors (the doors are for example of the type used in elevators which reopen as soon as they encounter an obstacle).

If a train is delayed by too great a period, the succeeding trains are automatically held back. In this way the succession of trains along the line is automatically stabilized and trains cannot bunch together behind a delayed train.

The availability of a higher operating speed for a train previously delayed, combined with slowing down and even stopping succeeding trains in the case of too great a delay, insures satisfactory operation in the case of a transport line in the form of a single loop.

Finally, if it is necessary to proceed at a very slow speed at any point of the track (for example because of repair work) this can be easily achieved by replacing one of the aforementioned reference marks upstream by a special reference mark which is also entirely passive.

Embodiments of the invention will now be described by way of example with reference to the accompanying drawing in which.

IMAGINARY TRAIN AND ANTI-COLLISION SAFETY

Figure 1:
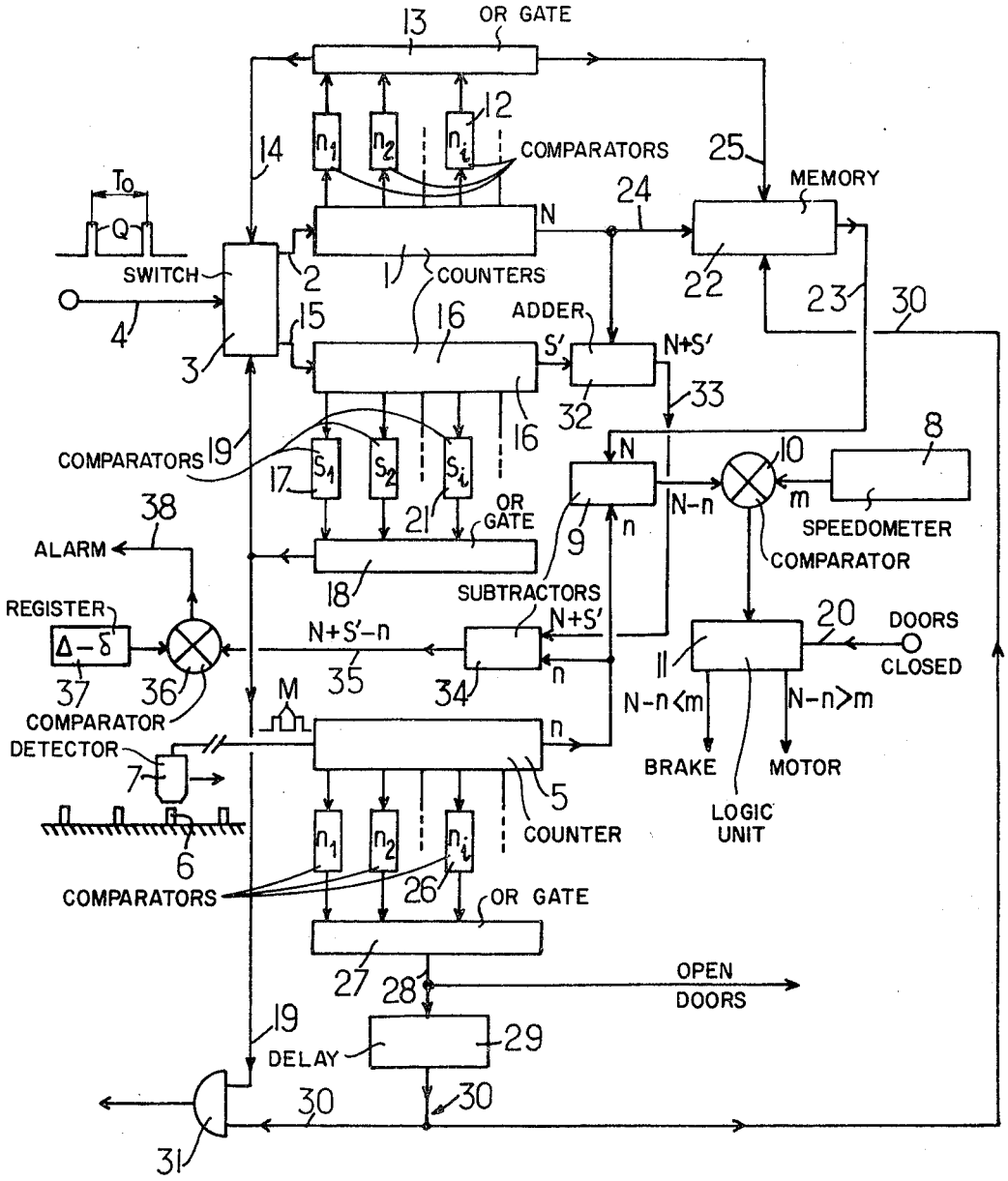
FIG. 1 is a block diagram of some of the components mounted on each vehicle.

As an illustrated mode of application of the invention there will now be considered an urban transport line in the form of a loop which the trains traverse in a time $\theta$. If P trains are in circulation and if they are uniformly distributed over the line (the retention of this uniformity is precisely the object of the "control" function), they will follow one another at each point of the line at intervals:

$$\Delta T = \frac{\theta}{P} \quad (1)$$

In order to obtain this uniformity it is necessary that the trains leave the terminus at the time:

$$Hp = Ho + (p-1)\,\Delta T \quad (2)$$

where $Ho$ is the departure time of the first train and $p$ is the number of the order of the train ($p$ being a whole number ranging from 1 to P).

Let us assume that there are placed along the track a number of entirely passive reference marks which are constructed in such a manner that each train may count them by conventional means. These reference marks will be spaced in such a manner that the time taken to traverse the distance separating any two successive reference marks has a constant value To for a train which is rigorously following its theoretical operating program. The name of "imaginary train" will be given to this ideal train.

An imaginary train (actually its operating schedule) is associated with each real train. If $n$ is the number of a given reference mark of the track, the time at which the imaginary train associated with the real train No. $p$ will pass over this reference mark is:

$$H_{np} = H_p + n\mathrm{To} \quad (3)$$

The time at which the imaginary train associated with the following train will pass over the same reference mark is:

$$H_{n(p+1)} = H_{p+1} + n\mathrm{To} \quad (4)$$

It is clear that if each real train is provided with an automatic device which compels it is pass each reference mark on the track between times $H_{np}$ and $H_{n(p+1)}$, no collision between the trains will be possible.

In order to provide this automation it is sufficient to install on board each train a clock and a reference-mark counter. At the moments when the train passes over each reference mark $n$ the time H(n) of the clock will be compared with the theoretical times $H_{np}$ and $H_{n(p+1)}$, and the condition:

$$H_{n(p+1)} > H(\mathrm{n}) > H_{np} \quad (5)$$

will be maintained by an automatic controller embodying my invention.

Thus, in order to insure anti-collision safety, it is not necessary to measure on board each train the distance which separates it physically from the preceding train.

Thanks to this fact no transmission of positional data needs to be effected between the trains.

The inequality $H(\mathrm{n}) > H_{np}$ signifies that the train No. $p$ must never overtake the imaginary train which is associated with it. This condition is easily realized automatically since it sufficies to decelerate the train as soon as $H(\mathrm{n})$ comes too close to $H_{np}$; the inequality $H_{n(p+1)} > H(\mathrm{n})$ signifies that train No. $p$ must not become delayed to the point that the imaginary train associated with the following real train catches up with it.

When a train is moving, and its propulsion system is operating normally, this condition is easily satisfied automatically: It suffices to accelerate the train if $H_{n(p+1)}$ comes too close to $H(\mathrm{n})$. But if, for any reason (passengers blocking the doors at the station, breakdown of the propulsion system, triggering of the alarm signal which is at the disposal of the passengers), a train finds it impossible to move on, it is unable to avoid being caught up with by the subsequent imaginary train.

In order to obviate this difficulty, I provide a positive safety-alarm system which allows any train about to be caught up with to stop the progress of all imaginary trains traveling on the line.

Thus if a real train stops, at a station or in the middle of the line, for a period of time such that the subsequent train might collide with it, the alarm system will stop all imaginary trains. The real trains will continue to move forward until they have rejoined their respective imaginary trains. The succession of trains will thus be immobilized in the ideal position which they should have had at the time of the alarm.

When the imaginary train restarts its movement, the entire system will thus restart from an ideal initial point. The only disturbance will be a general delay in the timetables of all the trains, but the spacing between the trains will be preserved.

The system is thus automatically stable and the "control" function is carried out automatically at the same time as the "anti-collision" function.

MEANS FOR PREVENTING THE REAL TRAIN FROM OVERTAKING THE IMAGINARY TRAIN.

The principle of the automatic unit satisfying the condition $$H(\mathrm{n}) > H_{np} \tag{6}$$

will be better understood with reference to FIG. 1 which shows an example thereof.

On board each train, as already mentioned, there is a clock. This clock is constituted by an electronic counter 1 which receives via an electronic circuit 3 constituting a changeover switch, whose function will be explained hereinafter, pulses Q spaced apart by a constant time interval To. These pulses are applied to the input 4 of this circuit.

The counter 1 is reset to zero, by a nonillustrated circuit, at the moment the train leaves its terminus. Consequently, if $N$ is the number shown on this counter at a given instant $t$ when the real train passes the $n^{th}$ reference mark, the time $H(\mathrm{n})$ will be $$H(\mathrm{n}) = H_p + N\,\mathrm{To} \tag{7}$$

as long as the train has not yet stopped at its first station after the terminus. The count N also indicates the number of the reference mark along the track where the imaginary train is located at the instant $t$. The imaginary train leaves the terminus at the time $Hp$ and moves forward by one reference mark at each interval of time $To$. Thus, the counter 1 registers the instantaneous position of the imaginary train.

On board each train there is also an electronic reference-mark counter 5 which receives a marker pulse M from a detector 7 each time the real train passes over a reference mark 6 on the track. The detector 7 may be constituted for example by a lamp and a photoelectric cell arranged in such a manner that when the train passes the reference mark the light beam is interrupted. Other conventional means may also be used as the detector 7.

The number $n$ shown on the counter 5 continuously indicates the order number of the reference mark which the real train has just passed. Thus, the counter 5 registers the instantaneous position of the real train.

The time $H(\mathrm{n})$ when the real train passes over the reference mark $n$ is given at this stage by the formula (7) and the time $H_{np}$ at which the imaginary train has passed over the reference mark $n$, a little earlier, is given by the formula (3).

The condition (6) can therefore be rewritten:

$$H_p + N\mathrm{To} > \mathrm{H}_p + n\mathrm{To} \tag{8}$$

whence $$N > n \tag{9}$$

To satisfy the condition (9) it is merely necessary to let the real train follow its imaginary train at a distance of only one segment, i.e. by the distance between two reference marks.

As discussed above, the maintenance of anti-collision safety necessitates under certain circumstances the halting of the progression of imaginary trains on the line. This halting takes place simply by interrupting the series of pulses Q in the input 4 of the switch 3. This results in a sudden stopping of the imaginary train, which is possible since this train has no physical reality and therefore no inertia.

If it is desired that the real train be able to stop without overtaking its imaginary train in the case where the latter stops suddenly, the former must always remain behind the latter by the braking distance:

$$D = \frac{v^2}{2\gamma} \tag{10}$$

where $v$ is the speed of the real train at the moment in question, and $\gamma$ is its minimum deceleration.

At the instant $t$ when the real train passes over the reference mark $n$, the imaginary train has reached its reference mark N. The distance between the two trains is thus:

$$D_n = (N\text{-n})\, l\,\mathrm{n} \tag{11}$$

where $l$ is the length of the segments at the point in question.

Thus:

$$l\,\mathrm{n} = v_n\,\mathrm{To} \tag{12}$$

The condition to be observed in order that the real train may stop without overtaking its imaginary train is:

$$D \leqslant D_n \tag{13}$$

or:

$$\frac{v^2}{2\gamma} \leqslant (N-n)\, v_n\, To \tag{14}$$

where $v_n$ is the speed of the imaginary train at the point in question of the track, i.e. the operating speed. It will be seen hereafter that the train is provided with an automatic device which realizes the condition.

$$v \leqslant a\, v_n \tag{15}$$

$a$ being a constant coefficient.

The condition (14) may be replaced by the more restrictive condition $$\frac{v}{2\gamma} a\, v_n \leqslant (N-n)\, v_n\, To \tag{16}$$

or:

$$v \leqslant (N-n)\, \frac{2\gamma To}{a} \tag{17}$$

The speed $v$ of the train is measured by a conventional speedometer 8 constituted for example by a detector which counts the number of teeth of a gear wheel of the propulsion system which pass in front of it during a given time.

The output of this speedometer 8 is a number $m$ proportional to the speed of the train:

$$m = kn \tag{18}$$

The condition (17) may thus be rewritten $$m \leqslant (N-n)\, k \quad \frac{2\gamma To}{a} \tag{19}$$

Calculations which would be too long to reproduce in the present description show that, in the case where the train is located in a part of the track where the speed of the imaginary train decreases regularly, as for example on the approach to a station, the safety condition (13) can be satisfied only if a more restrictive condition as follows is imposed:

$$m \leqslant (N-n)\, k \quad \frac{\gamma To}{a} \tag{20}$$

The speedometer detector 8 is thus so constructed that $$k = \frac{a}{\gamma To} \tag{21}$$

and consequently the condition to be satisfied in order that the actual train follows its imaginary train without ever overtaking it is $$m \leqslant (N-n) \tag{22}$$

This condition is produced in the following manner: The numbers $N$ and $n$ registered by the counters 1 and 5 are applied to a binary subtractor 9. The number N reaches the subtractor by way of a memory 22 whose function will be explained later. For the moment we will assume that this memory acts as a simple connection. The output (N-n) of this subtractor is compared with the output $m$ of the speedometer 8 by means of a comparator 10. This comparator is associated with a logical decision unit 11 which produces the following commands:

If $m < N-n$: The motors of the train are started
If $m = N-n$: The train is allowed to continue
If $m > N-n$: The train is decelerated.

Thus, the position-control network just described compels the real train to trail its associated imaginary train by a distance D at least equal to the braking distance.

STOPPING AT A STATION

If it is desired to stop the train at a station "$i$" in a position such that the reference-mark detector 7 comes to rest between the reference marks $n_i$ and $n_i$+1, the position counter 1 assigned to the associated imaginary train is to be stopped upon registering the number $n_i$. For this purpose there is used a coincidence device or comparator 12 preset to the number $n_i$. When the counter 1 reaches the number $n_i$ the comparison circuit 12, by way of an OR gate 13, acts on the control input 14 of the switchover circuit 3. There results a reversal of this switch which, instead of sending the pulses Q from its inputs 4 to its output 2, now sends them to its output 15.

Figure 2:
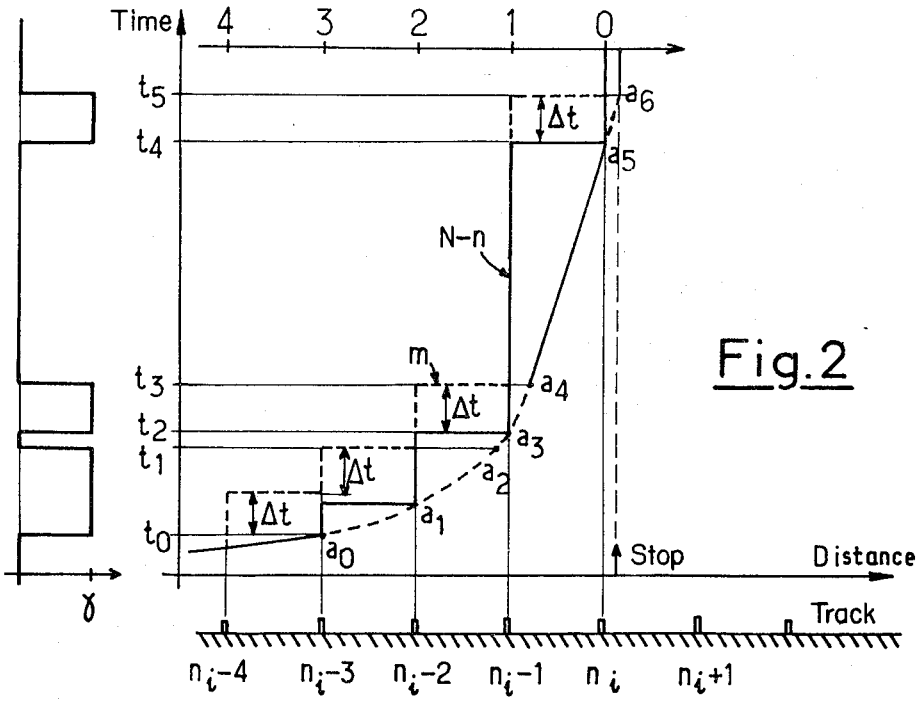
FIG. 2 illustrates, in a distance/time diagram, the braking phase of a real train for stopping between stations.

Since the position counter 1 receives no more pulses, everything takes place as if the imaginary train had stopped at the reference mark $n_i$. The automatic controller, whose operation has been described, thus causes the stopping of the real train at the station $i$. FIG. 2 shows as an example, in a distance-time diagram, the breaking phase of the real train. It is assumed that the stopping of the imaginary train on the reference mark $n_i$ takes place at the instant when the real train arrives at the reference mark $n_i$–4. The train is thus making headway, i.e. $m = N-n = 4$.

At the instant $t_o$ when the train passes over the mark $n_i$–3, the number $N-n$ decreases by one and the speed-related value $m$ becomes greater than $N-n$. This results in the initiation of braking with a deceleration $\gamma$. Let us call $\Delta t$ the time at the end of which the decrease in speed due to the braking action causes the number read out from the speedometer 8 to decrease by one. It can be seen from the graph that $m$ remains greater than N-n only until the instant $t_1 = t_o + 2\,\Delta t$; at this point $m$ decreases to the value 2 before N-n passes from the value 2 to the value 1. Braking is now suspended until the instant $t_2$ when the train passes over the reference mark $n_i$–1. At this instant N–n again becomes less than $m$ and the braking action resumes, continuing to the instant $t_3 = t_2 + \Delta t$ when $m$ again decreases by one and thus becomes equal to N–n, and so on.

The automatic controller thus modulates the braking action much as a human operator would; the deceleration curve of the train is formed by a succession of parabolic arcs ($a_o$–$a_2$, $a_3$–$a_4$, $a_5$–$a_6$) and straight segments ($a_2$–$a_3$, $a_4$–$a_5$).

Thus, even if the deceleration coefficient $\gamma$ of the train does not always have the same value, the stopping position will always be located between the reference marks $n_i$ and $n_i$+1.

Figure 3:
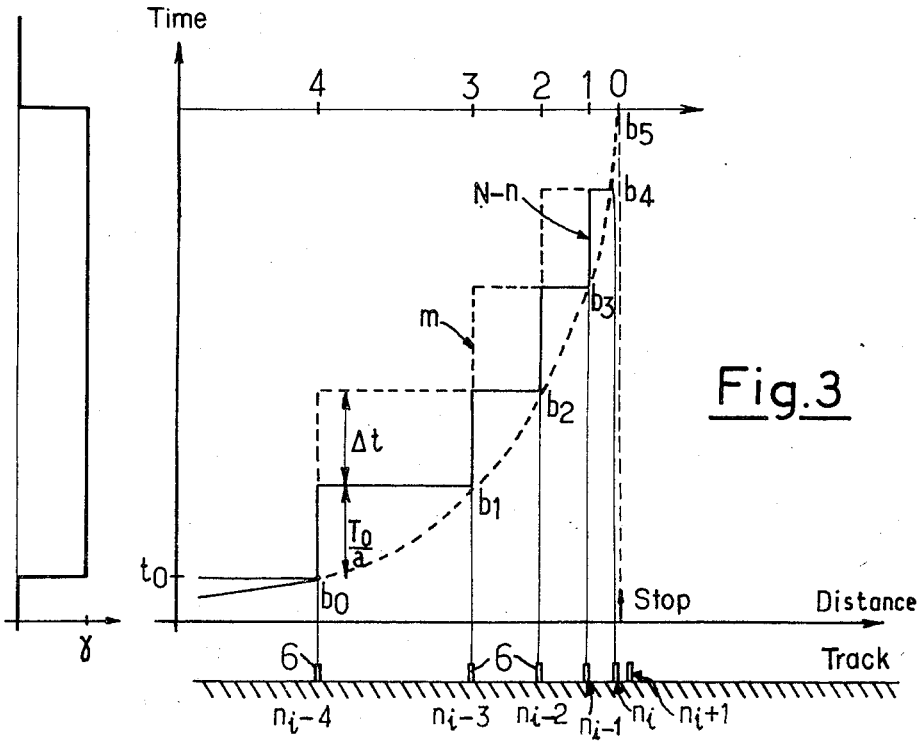
FIG. 3 represents a smooth-braking diagram designed for stopping at a station.

FIG. 3 shows a modified deceleration curve designed to prevent discomfort for the passengers resulting from successive sudden braking as is the case with the curve of FIG. 2.

In order that $m$ be always greater than N–n and that $\gamma$ remain constant throughout the entire braking phase it is required that:

$$\Delta t = To/a \tag{23}$$

If it is desired that the speed of the train decrease in a linear manner, this condition can be maintained throughout the braking phase only if the length of the segments separating the successive reference marks decreases according to a law of arithmetic progression. This is shown in FIG. 3.

The decrease in length of the segments not only facilitates a smooth braking but also makes it possible to determine with great accuracy the stopping position of the train since the latter is necessarily located between the reference marks $n_i$ and $n_i$+1 and since the distance between these two reference marks is very small.

FIGS. 2 and 3 are given only as examples of the braking process. In reality, the stopping of the train takes place over a distance including a greater number of reference marks.

STOPPING TIME AT A STATION

Obviously there are as many coincidence devices 12 as there are stations on the line. When one of these devices has reversed the change-over switch 3, a counter 16 receives the pulses Q of period To. The trains must stop at the various stations for intervals $t_1$, $t_2 \ldots t_i$ established by the timetable of the line. These intervals are chosen from multiples of To, i.e.:

$$t_1 = s_1\text{To},\ t_2 = s_2\text{To}, \ldots t_i = s_i\text{To} \quad (24)$$

The counter 16 is provided with coincidence devices 17, 21 identical with the comparators 12 served by the counter 1. These devices are preset to the following magnitudes:

$$S_1 = s_1;\ S_2 = s_1 + s_2;\ S_i = \sum_{j=1}^{i} s_j \quad (25)$$

The counter 16, which determines the stopping time of the imaginary train, is reset to zero as the train leaves the terminus. On arrival at the first station it has counted $S_1$ pulses Q which requires a time $t_1$. At the end of this time the corresponding coincidence device 17 generates a pulse which, via an OR gate 18, is transmitted to the change-over switch 3 which is thereby restored to its original position. The pulses Q then again pass through the output 2 of the reversing switch and are once more directed to the counter 1 which again begins to count from the value $n_1$ where it has stopped. The imaginary train is thus restarted. Comparators 12, 17, 21 form part of a programmer for the actuation of switchover means 3.

On standstill we have $m = O$, $n = n_i$ and $N = n_i$. As soon as the counter 1 begins to count, N becomes greater than $n_i$ and immediately $m < N-n$.

The comparator 10 and the logical decision unit 11 thus produce a command which reoperates the motors of the real train. This starting up of the real train can occur only if the logic unit 11 receives by way of its input 20 a signal authorizing its departure which indicates that the doors have been closed.

On arrival at the station $i$ the number appearing in the counter 16 is $S_{i-1}$. This counter, therefore, must now register $s_i$ further pulses before the coincidence device 21 set to the figure $S_i$ initiates the departure of the imaginary train.

Thus the time during which the imaginary train is halted at the station $i$ will be the predetermined interval $t_i$ which can be easily changed by readjusting the coincidence devices.

Let us now consider the case of a real train which has been somewhat delayed at the preceding station and, not having been able to make this up in the stretch between the two stations, arrives at the station $i$ with a delay $t_r$. If precautions were not taken this train would halt at the station $i$ for only a period of time $t_i$–$t_r$ which could be too short to allow passengers to board and disembark. Moreover, if $t_r$ were greater than $t_i$ the train would no longer stop at the station.

To remedy this state of affairs I provide the aforementioned memory 22 between the counter 1 and the subtractor 9. This memory is a binary electronic circuit which assumes one of two states: "clear" and "blocked".

In the "clear" state the memory 22 presents at its output 23 the same figure N which appears at its input 24 and is thus equivalent to a direct connection between the counter 1 and the subtractor 9. In the "blocked" state, it retains at its output the number which was at its input at the time of blocking, whatever the number subsequently fed to it.

Each time the imaginary train arrives at a station the memory 22 receives from the gate 13 a blocking signal by way of the wire 25. In this way, even if the imaginary train restarts, the number $N_i$ is preserved at the input 23 of the subtractor 9, which allows the real train to stop at the station $i$ whatever its delay.

The position counter 5 for the real train is provided like the counter 1 with a set of comparators forming part of the programmer, i.e. with coincidence devices 26 preset to the numbers $n_1, n_2, \ldots n_i$. Thus, an OR gate 27 transmits a signal by way of its output 28 to a delay unit 29 each time the real train stops at a station. This signal also serves for controlling the opening of the doors.

Delay unit 29 is an electronic time switch which produces an output signal at a time $t'$ after it has received an input signal. The delayed signal which appears at the output 30 thus causes the unblocking of the memory 22 which is thus reset to its "clear" state. Thus, after a delay $t'$ from the time when the train stopped at the station, the pulse count transmitted to the input 23 of the subtractor 9 is updated and passes from the value $N_i$ to the value N then registered in the output of the counter 1, whereupon the real train restarts. In the case where the train is not delayed, i.e. where the time $t'$ ends earlier than the interval $t_i$, the train does not leave the station until its imaginary train has also restarted. In fact $t'$ is adjustable and may also be equal to or greater than $t_i$; in the latter instance the imaginary train will always depart with a certain head-start relative to the real train.

The closing of the doors is controlled by an AND gate 31 which receives the output signals of components 18 and 29 on leads 19 and 30. Thus the closure of the doors occurs as soon as these two conditions are simultaneously satisfied: the imaginary train has restarted and the real train has been stationary for at least a period $t'$.

The delay $t'$ of device 29 may be adjustable to vary from one station to another.

ANTI-COLLISION SAFETY

It has been explained above that the anti-collision feature of my invention requires that a train on the point of being overtaken by the imaginary train associated with the next-following real train actuates an alarm which causes a stoppage of all the imaginary trains circulating on the line. This action is obtained in the following manner: The condition to be observed is $$H_{n(p+1)} > H(\text{n}) \quad (26)$$

i.e. the time $H(\text{n})$ at which the train passes over the reference mark $n$ must precede the time $H_{n(p+1)}$ at which the next imaginary train will pass over the same reference mark. Taking into account the relationships (2) and (4) we may write:

$$H_{n(p+1)} = H_p + \Delta T + \text{n}To + \text{S}_i.\text{To} \quad (27)$$

where $S_i$.To is the total theoretical stopping time provided in the timetable of the imaginary train No. $p$+1 for all the stations where it has already stopped. The time $H(\text{n})$, given by equation (7) as long as the train has not stopped at the first station, can be more generally represented by the relationship $$H(\text{n}) = H_p + (N+\text{S})\ To \quad (28)$$

Consequently, if ΔT is also a multiple of To, i.e. if $$\Delta T = \Delta \cdot To \quad (29)$$

(Δ being the number of segments separating two successive imaginary trains), condition (26) may be rewritten:

$$H_p + \Delta.To + (n+S_i)\ To > H_p+(N+S).To \quad (30)$$

or $$(N+S') - n < \Delta \quad (31)$$

wherein $S' \equiv S-S_i$.

It is easy to introduce a margin of safety into the segments by imposing not the inequality 31 but the more restrictive inequality $$(N+S') - n < \Delta - \delta$$

In the embodiment of the invention illustrated in FIG. 1 this latter inequality is respected in the following manner:

An adding device 32 adds the two numbers N and S′ shown at the outputs of counters 1 and 16. The number S′ is easily obtained from a conventional unit not shown, included in the counter 16, which subtracts from the actual pulse count S, after the departure from each station *i*, the number $S_i$ representing the theoretical stopping time at that station *i*. The number N + S′ which appears in the output 33 of adder 32 is sent to a subtractor 34 which registers the number N + S′ − *n* at its output 35. This number is compared by a comparator 36 with the constant threshold value Δ − δ stored in a register 37. By adjusting this register it is very easy to modify Δ (as would be necessary if the interval ΔT between trains were changed) or δ if it is desired to modify the margin of safety.

As soon as the inequality (32) is no longer confirmed, an alarm signal appears at the output 38 of the comparator 36.

Whenever this alarm occurs on board any one of the trains traveling on the line, all the imaginary trains must be stopped. In order to do this it is sufficient to stop all the internal clocks on each train, i.e. counters 1 and 16, by simply discontinuing the emission of pulses Q to the inputs 4 of the automatic drive systems thereof.

Figure 4:
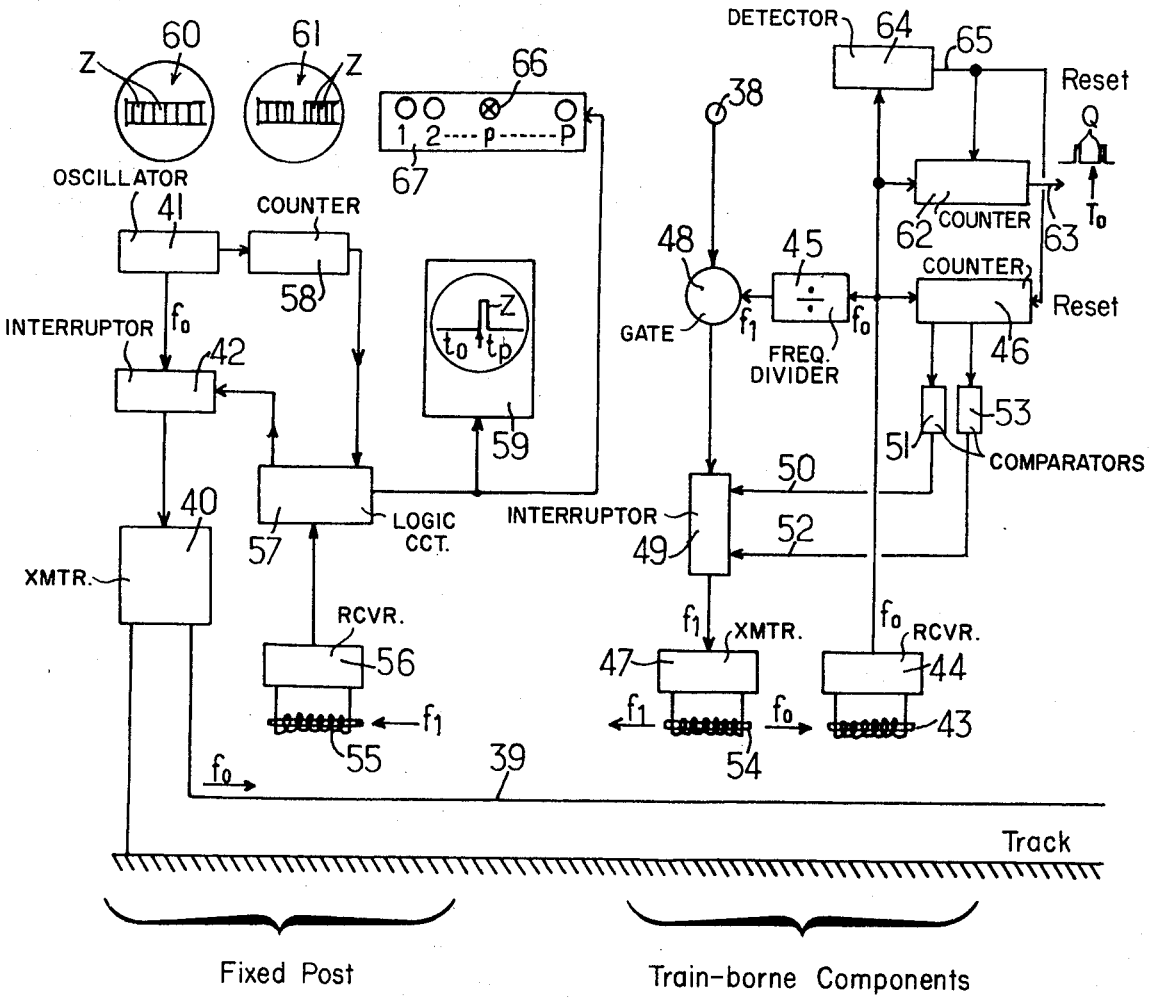
FIG. 4 is a diagram of a unit designed to stop the transmission of signals relating to imaginary vehicles in the case of an alarm signal in a real vehicle.

FIG. 4 shows a circuit arrangement according to the invention which makes it possible to stop the generation of pulses Q on board all trains when an alarm occurs in one of them. This Figure also shows at 39 the aforementioned signal wire extending along the track.

At some point on the line (e.g. at the terminus, but this choice is not obligatory) a central control post is fixedly located, comprising a transmitter 40 which supplies the wire 39 with alternating current at a timing frequency fo. This transmitter is controlled by a high-stability oscillator 41 to which it is connected by way of an interrupter 42.

For explanatory purposes the following numerical values will be given by way of example: Let us assume that there are 25 trains traveling on the line and that the chosen basic period To is 0.5 second. The frequency fo is 100 kHz.

At an instant $t_o$, the interrupter 42 conducts and the current of frequency fo is sent along the wire 39 by the transmitter 40. This current creates a magnetic field along the line which is picked up on board each of the trains by a coil 43 associated with a receiver 44. This receiver thus sends an oscillation of frequency fo to a divider 45 and to a counter 46. The divider steps down the basic frequency *fo*, e.g. by halving it. Thus at its output there is a frequency $f_1$ of 50 kHz. This modified frequency is sent to a transmitter 47 by way of a gate 48 and an interrupter 49. The latter interrupter is normally cut off but conducts when a signal is sent to its input 50 by a coincidence device or comparator 51 which responds when the counter 46, which counts the cycles of the oscillation of frequency *fo*, has arrived at the number 1000p, *p* being the order number of the train in question. Since in the chosen example each cycle of the timing oscillation fo lasts for 10μs, the interrupter 49 conducts at the instant $$t_p = t_o + 0.01\ p \text{ sec.} \quad (33)$$

The interrupter 49 is again cut off at an instant $t_{p+1}$ by a similar process when its input 52 receives from another coincidence device or comparator 53 a signal indicating that the counter 46 has arrived at the number 1000 (p+1). The counter 46 automatically returns to zero when it has reached the number 25,000.

Thus between the instants $t_p$ and $t_{p+1}$ the transmitter 47 sends an oscillation of 50 kHz to a coil 54 which induces a current of the same frequency in the wire 3. This current produces a signal in a pick-up coil 55 of a receiver 56 located at the central control post. The signal picked up by this receiver 56 is sent to a logic circuit 57 which moreover receives rectangular pulses Z of 0.01 sec. width supplied to it by a counter 58 which counts the cycles of the oscillator 41. If the receiver 56 receives a feedback signal of 50 kHz during the $p^{th}$ rectangular pulse Z, this pulse appears at the corresponding position on a monitoring screen 59 placed in front of the operator in the central control post.

The 25 trains traveling on the line thus each emit a signal of 50 kHz between the instants $t_p$ and $t_{p+1}$ respectively allocated to them. When the transmitters of all the trains operate in the proper sequence, the rectangular pulses Z are closely juxtaposed on the monitoring screen 59 which therefore produces a continuous display 60. When the system is in this condition, the logic circuit 57 leaves the interrupter 42 permanently conductive and an oscillation of frequency fo is sent continuously to the wire 39.

Thus on board each train another cycle counter 62, which is set to produce an output pulse each time it reaches the number 50,000 (i.e. every half second), produces pulses Q spaced by the interval To at its output 63. These pulses are sent to the input 4 of the automatic drive system illustrated in FIG. 1. Thus the pulses To of each of the trains are all controlled by the very stable oscillator 41 of the central control post and are all strictly synchronous and isochronic.

If on board one of the trains an alarm signal appears at the output 38 of the comparator 36, it will have the effect of closing the gate 48 and the transmitter 47 of the train will emit nothing during the period of time between the instants $t_p$ and $t_{p+1}$. The pulse Z corresponding to the train which signals an alarm will thus be missing and the screen 59 at the central post will produce a discontinuous display 61.

In this case the logic circuit 57 cuts off the interrupter 42 a quarter of a second after the instant $t_o$ tha marks the beginning of the monitoring cycle of 25 rectangular pulses Z during which the transmission from the train No. $p$ was missing.

There results a cessation of transmission from the central post and on board all the trains the receivers 44 are without an input. This cessation of the transmission is sensed by a detector 64 which thereupon sends to the counters 46 and 62, via a lead 65, a control signal to reset them to zero. It will be noted that this resetting to zero occurs at an instant when these counters register the number 25,000.

The logic circuit 57 continues to receive rectangular pulses Z of 0.01 sec. width from the counter 58; this allows it to restore conduction through interrupter 42 a quarter of a second after it was open-circuited. The monitoring cycle which has been described then recommences and the logic circuit 57 again receives feedback signals from each of the trains.

If the gate 48 of the train in which the alarm occurs is still closed, the corresponding rectangular pulse Z will still be missing and the logic circuit 57 will cut off the interrupter 0.25 second after having restored its conductivity.

Thus, if all the trains retransmit sequentially, transmission from the central post is continued and the counters 62 of all the trains produce pulses Q which are regularly spaced 0.5 sec. apart.

But if retransmission from one or more trains is absent, transmission from the central post takes place intermittently during periods of 0.25 sec. separated by quiescent periods of like duration. Thus all the counters 62 of the trains are constantly reset to zero at the count of 25,000 and never reach the count of 50,000 on which they produce a pulse. Hence, the transmission of pulses Q to the inputs 4 of the automatic systems ceases aboard all the real trains and stops all the imaginary trains.

The logic circuit 57 identifies the time position of the missing pulse Z and causes a lamp 66 to be illuminated on an alarm board 67 which indicates which train has initiated the alarm.

When the alarm stops, the gate 48 is reclosed and the circuit 57 again receives all the bursts of retransmission frequency $f_1$ during the following sequence of 25 pulses Z. It thus leaves the interrupter 42 permanently conductive and the receivers 44 of all the trains again pick up a continuous transmission of basic frequency $fo$. The counters 62 may thus count up to 50,000 and the pulses Q are again sent to the automatic drive systems of the trains. Thus all the imaginary trains restart simultaneously.

The system which has been described, and which helps realize the objects of my invention, operates in a closed loop affording a high degree of reliability. Even if only one of the elements forming the block diagram of FIG. 4 breaks down, this results in a general stoppage of all the trains on the line. The anti-collision system according to the invention thus is absolutely fail-safe. Its response period is at most To/2. This response period can be taken into account easily by adopting a value of $\delta$ at least equal to 1 in equation (32).

From the point of view of transmission of signals this system is also very reliable. In fact it is very simple and uses only two frequencies $fo$ and $f_1$ which are harmonically related to each other. Furthermore, its insensitivity to interference is very great.

Indeed, if it is assumed that the receiver 44 of one of the trains picks up at a certain moment a train of interference signals such that as a result additional pulses are applied to the counter 46, the latter will simply be advanced and the retransmission from the train will no longer take place during the pulse cycle Z which is reserved for it.

This will be interpreted by the central control post as an alarm and the transmission will be stopped for 0.25 sec. At the end of this time the normal sequence will restart and the entire system will resynchronize. This synchronization is obtained by means of the resetting to zero of the counter 46 by the detector 64 at the time of each cessation of transmission from the central post.

OBSERVATION OF SPEED LIMITS AND COMPENSATION FOR THE DELAYS OF THE TRAINS

The distance $l_n$ separating the reference mark $n$ from the reference mark $n-1$ is defined by the relationship:

$$l_n = v_n \mathrm{To}, \tag{34}$$

$v_n$ being the speed at which the imaginary train should be traveling at the point in question of the track. Speed $v_n$ is determined by the theoretical operating program and takes into consideration the speed limits resulting from the course of the track. This is translated into a smaller spacing between the reference marks 6 in the curves.

The imaginary trains thus follow the operating program rigorously and since the real trains are prevented from overtaking their associated imaginary trains, any real train which is not delayed also follows the operating program and observes the speed limits.

The case of a train will now be considered which has been delayed on leaving the station, e.g. because the non-closure of a door has prevented it from starting when it should have.

My present system as described hereinabove lets this train travel as quickly as the power of its motors will allow until it has made up its delay with respect to its imaginary train.

This enables automatic compensation of small delays, i.e. those not liable to create a danger of collision and therefore not causing a temporary stopping of the succession of imaginary trains. But it is clearly necessary to provide some limit which prevents trains from traveling at too great a speed, since otherwise a train having experienced excessive delay could go around curves at its maximum speed.

According to a feature of my invention this limit is imposed by measuring a transit time T′ which intervenes between encounters of the train with two successive reference marks. This time T′ is compared with a reference time To/a:

If T′ > To/a the comparator does not intervene.
If T′ = To/a the comparator cuts the motors off.
If T′ < To/a the comparator initiates braking.

The result is that the speed of the real train may never become greater than $a.v_n$.

The factor $a$ must be a coefficient greater than 1, if it is desired that the real train may make up its delay with respect to its imaginary train. But, if it is possible to assume that on straight lines a train may travel at a maximum speed:

$$v_{max} = a.v_n \tag{35}$$

greater than its theoretical operating speed $v_n$, on the other hand it is desirable that in a curve the speed $v_{max}$ does not exceed the normal operating speed $v_n$. To this end I provide before the curve a special reference mark which, when the train passes thereabove, changes in the comparator the coefficient $a$ from a value greater than 1 to the value 1. After the curve, another reference mark restores the original value of the coefficient $a$.

In such a system the coefficient $a$ may also assume a third value, less than 1, when the train passes over a further special reference mark. For example, this latter reference mark may be placed sufficiently ahead of a region where work is being carried out in order to hold the trains to a very slow speed as they pass through this region.

Figure 5:
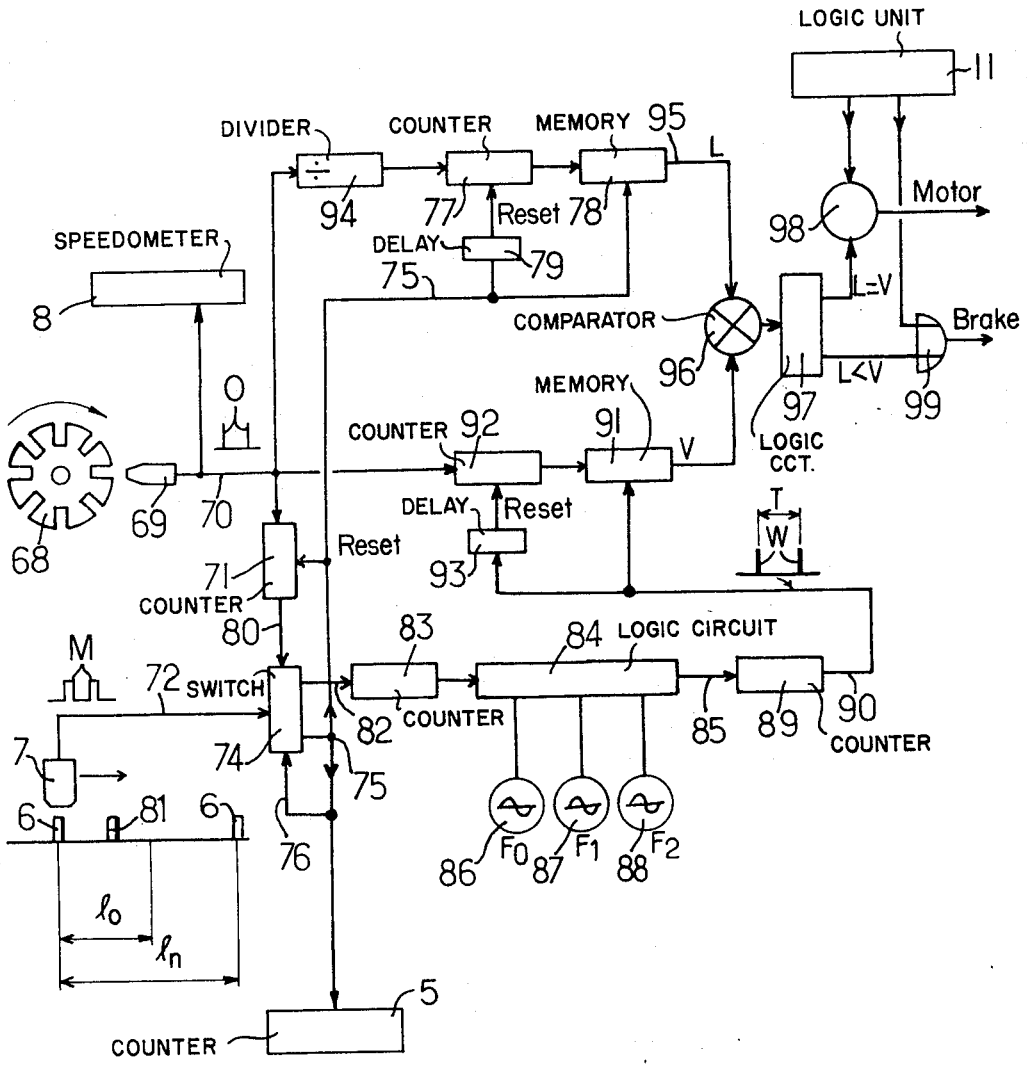
FIG. 5 illustrates circuitry insuring the limitation of the speed of a real vehicle in dangerous zones.

FIG. 5 shows as an example one possible embodiment of this aspect of the invention. A notched or slotted wheel 68 is keyed to a drive shaft of the train. A detector 69, which may be of the magnetic or photoelectric type, or any other conventional odometer supplies a pulse O at its output 70 each time one of the slots passes in front of it. These pulses are sent to the speedometer 8 (cf. FIG. 1) and also to a counter 71.

The detector 7 coacting with marks 6 is not directly connected to the counter 5, as is illustrated in FIG. 1 for the sake of simplification, but delivers its marker pulses to an input 72 of a reversing switch 74.

It will be assumed that initially the reversing switch 74 is in its lower position, i.e. it sends to its output 75 the pulses M applied to its input 72. In this case the first reference mark encountered by the train (a normal reference mark 6, for example) sends a pulse M to the output 75. This pulse has several effects:

it is applied to the counter 5 which thus advances the position reading $n$ of the real train by one;

it resets the counter 71 to zero;

it is applied to a control input 76 of the reversing switch 74 and causes the latter to move into its upper position; and it causes the transfer of a number registered in a counter 77 into a memory 78 and then (after having been slightly delayed by a delay circuit 79) resets the counter 77 to zero.

The slotted wheel 68 advances by one slot each time the train has covered a distance l. The counter 71 counts the pulses O up to a number λ. When it arrives at this number it blocks itself by sending a pulse to a control input 80 of the reversing switch 74 which restores same to its lower position. This occurs when the train has moved forward by a distance $$l_o = \lambda l \tag{36}$$

from the last reference mark which had caused the counter 71 to be reset to zero. Thus a marker pulse M is entered in the train-position counter 5 only if the corresponding reference mark is separated by a distance greater than $l_o$ from the preceding reference mark.

If a supplemental reference mark 81 (of the same structure as the normal reference marks 6) is placed at a distance less than $l_o$ from a preceding mark 6, the resulting marker pulse M at the output 72 of the detector 7 will be directed to an alternate output 82 of the reversing switch 74 and registered by a supervisory counter 83.

The counter 83 counts up to 3 and returns to zero when it receives its fourth stepping pulse. It is associated with a logic circuit 84 which, according to the state of the counter 83, switches to its output 85 one of the frequencies $F_0$, $F_1$, $F_2$ coming from three oscillators 86, 87, 88.

If the counter 83 registers the number zero it is the frequency $F_0$ which will appear on lead 85; frequency $F_1$ is present if the counter registers the number 1, and frequency $F_2$ is used it it registers the number 2.

Another counter 89 counts the cycles of the frequency which exists at its input 85 and delivers a pulse W at its output 90 each time it has counted $q$ cycles. The time T separating two successive pulses W is thus $$T = \frac{q}{F_i} (i = 0, 1, 2) \tag{37}$$

and represents a measuring period whose duration depends on the setting of frequency selector 83, 84.

These pulses W are used to effect the transfer to a memory 91 of the number shown in a counter 92 and to reset the counter 92 to zero after having been slightly delayed by a delay circuit 93.

The counter 92 receives the odometer pulses O on a lead 70 from the detector 69. The reading of the counter 92 will be the number V of slots in the wheel 68 which have passed in front of the detector 69 during the measuring period T, i.e.

$$V = \frac{vT}{l} = \frac{vq}{lF_i}, \tag{38}$$

$v$ being the instantaneous speed of the train during the measuring period T.

The pulses from the detector 69 are also sent to the input of the counter 77 via a divider 94 which divides their recurrence rate by a constant K.

The number L which is presented at the output 95 of the memory 78 is thus:

$$L = \frac{l_{n-1}}{lK}, \tag{39}$$

$l_{n-1}$ being the length of the segment located between the reference marks Nos. n−1 and $n$ that the train has just passed; hence, $$l_{n-1} = v_{n-1} . To, \tag{40}$$

$v_{n-1}$ being the programmed speed, i.e. the velocity of the imaginary train. The speed-limitation condition is:

$$v \leqslant a.v_n \tag{41}$$

If all the segments are subjected to a unit shift with reference to the speed subscripts, i.e. if the length of one segment is proportional to the speed that the real train must not exceed on the following segment, condition (41) may be restated according to equations (38) and (39) as follows:

$$\frac{VlF_i}{q} \leqslant \frac{aKlL}{To} \tag{42}$$

or $$V \leq \frac{aKqL}{F_i To} \quad (43)$$

The frequencies $F_i$ should be so chosen that $$\frac{Kq}{To} \cdot \frac{a}{F_i} = 1 \quad (44)$$

in order that the speed-limitation condition (41) can be expressed by $$v \leq L \quad (45)$$

The two numbers $V$ and $L$ are compared by a comparator 96 associated with a logical decision circuit 97 in order to generate the following commands:

If $L > V$ no command is produced.

If $L = V$ a starting of the motors in response to a possible command from the logic circuit 11 is prevented by closure of a gate 98.

If $L < V$ the gate 98 is closed and a braking command is produced. This command is added possibly by an OR gate 99 to a possible braking order coming from the logic circuit 11. Thus, the train is decelerated whenever the relative magnitude of the pulse counts $V$ and $L$ exceeds a predetermined ratio, i.e. unity in this specific instance.

This speed-limiting feature of my invention has the advantage of controlling the speed of the train $K$ times throughout the length $l_n$ of one segment.

It also makes it possible to change the value of the coefficient $a$ by the use of identical reference marks which are entirely passive, without requiring additional detectors.

The case where no specially positioned reference mark is encountered in a stretch of length $l_o$ after a normal reference mark 6 corresponds to a straight course. The counter 83 thus registers zero and the frequency $F_i$ will equal $F_o$. If $v_n$ is the normal operating speed limited for example to 60 km/h it will be necessary that the trains are not restrained before reaching 80 km/h which corresponds to a coefficient $a_o = 1.33$. Thus:

$$F_o = \frac{1.33\,Kg}{To} \quad (46)$$

Ahead of any curve or bend, a supplemental reference mark is disposed between successive marks 6. The counter 83 will thus register the number 1 and the frequency $F_1$ will be selected. It will thus be convenient to make $a_1 = 1$ which will be realized if:

$$F_1 = \frac{Kg}{To} \quad (47)$$

At the end of the bend three supplemental reference marks 81 will be successively placed behind a normal reference mark 6. The counter 83 will register them and return to the number zero, selecting the frequency $F_o$.

In the case where a train approaches a work area, two supplemental reference marks 81 will be successively positioned behind a reference mark 6. The counter 83 will thus assume its second state, selecting the frequency $F_2$. If for example it is desired to limit the speed to 20 km/h while the train passes through this work area, it is necessary to make $a_2 = 0.33$, i.e. to select $$F_2 = 0.33\,\frac{Kg}{To} \quad (48)$$

At the end of the work area two supplemental reference marks 81 will be located with the effect of resetting the counter 83 to zero and returning the speed of the trains to their normal value. It should be noted that these supplemental marks 81 do not interfere with the counting of the normal reference marks by the counter 5 since the pulses M deviated to output 82 do not reset the distance counter 71.

These speed-limiting values and the combinations of reference marks 81 which control them are only given as examples and could obviously be modified within the scope of the invention.

What is claimed is:

1. In a system for controlling the movement of a plurality of self-propelled bodies, provided with propulsion means and braking means, following one another in a predetermined order on a track serving a number of stations, said system including a fixed post for the periodic emission of a timing signal and markings spacedly disposed at fixed reference points along said track, the improvement wherein each of said bodies comprises:

receiving means for detecting said timing signal and converting same into a series of isochronous pulses;

first counting means connected to said receiving means for registering a count N of said isochronous pulses;

sensing means responsive to said markings for generating a marker pulse upon movement of the body past any of said reference points;

second counting means connected to said sensing means for registering a count n of said marker pulses;

calculating means connected to said first and second counting means for determining the difference N—n of the counts thereof; and decision means connected to said calculating means for actuating said propulsion means upon said difference N—n at least equaling a certain reference value and for actuating said brake means upon said difference N—n falling short of said reference value.

2. The improvement defined in claim 1 wherein each of said bodies further comprises tachometric means for generating a speed-proportional signal with a numerical value m constituting said reference value.

3. The improvement defined in claim 1 wherein each of said bodies further comprises switchover means inserted between said first counting means and said receiving means, third counting means connectable by said switchover means to said receiving means in lieu of said first counting means for registering a count S of isochronous pulses, a plurality of first coincidence detectors connected to different stages of said first counting means for determining the occurrence of predetermined first readings corresponding to scheduled arrival times at respective stations, first circuit means connecting said first coincidence detectors to said switchover means for reversing the latter upon the occurrence of any of said first readings to switch said isochronous pulses from said first to said third counting means, a plurality of second coincidence detectors connected to different stages of said second counting means for determining the occurrence of predetermined second readings indicating the actual arrival at any of said respective stations, clamping means inserted between said first counting means and said calculating means for temporarily arresting said count N as delivered to said calculating means, second circuit means connected to said second coincidence detectors for controlling said clamping means to prevent updating of said count N for a predetermined minimum period upon arrival at any of said respective stations irrespective of the position of said switchover means, a plurality of third coincidence detectors connected to different stages of said third counting means for determining the occurrence of predetermined third readings measuring scheduled standstill periods at said respective stations, and third circuit means connecting said third coincidence detectors to said switchover means for restoring same upon the occurrence of any of said third readings to switch said isochronous pulses back from said third to said first counting means.

4. The improvement defined in claim 3 wherein said clamping means comprises a memory blockable by said first circuit means for temporarily storing the value of said count N upon reversal of said switchover means, said memory being unblockable by said second circuit means to update said count N.

5. The improvement defined in claim 4 wherein said second circuit means includes a delay network.

6. The improvement defined in claim 5 wherein each of said bodies is provided with door-opening means jointly controlled by said third coincidence detectors and said delay network.

7. The improvement defined in claim 3 wherein each of said bodies further comprises arithmetical means connected to said first, second and third counting means for calculating a resulting value $N+S'-n$ where $S'$ is the difference between the current count S and the highest reading detected by said third coincidence means, comparison means connected to said arithmetical means for comparing said resulting value with a predetermined safety threshold, and alarm means connected to said comparison means for emitting an emergency signal upon said resulting value falling short of said safety threshold.

8. The improvement defined in claim 7 wherein said post is provided with alarm-responsive means for suspending the emission of said timing signal in the presence of said emergency signal.

9. The improvement defined in claim 8 wherein each of said bodies is provided with retransmission means for normally sending back to said control post a confirmation signal, said alarm means being connected to said retransmission means for emitting said emergency signal as the negation of said confirmation signal.

10. The improvement defined in claim 9 wherein said confirmation signal is a rectangular pulse filling a time slot allocated to the respective body in a series of contiguous time slots, said control post including pick-up means for synthesizing a continuous voltage from the confirmation signals of all said bodies in the absence of an alarm condition, said alarm-responsive means comprising logical circuitry connected to said pick-up means for detecting a gap in said continuous voltage due to the absence of a confirmation signal from at least one of said bodies.

11. The improvement defined in claim 1 wherein each of said bodies is provided with odometric means for measuring the distance traveled from the last reference point detected by said sensing means, signaling means jointly controlled by said odometric means and said sensing means for indicating the presence of a special marking disposed along said track between successive reference points at less than a predetermined distance from said last reference point, and speed-limiting means responsive to said signaling means for actuating said brake means independently of said decision means.

12. The improvement defined in claim 11 wherein said speed-limiting means includes an ancillary counter for consecutive special markings and timing means controlled by said ancillary counter for setting progressively lower speed limits with increasing numbers of special markings up to a maximum count beyond which said ancillary counter restores said timing means to normal.

13. A system for controlling the movement of a number of self-propelled bodies provided with automatic drive means, said bodies traveling one after the other on a track, comprising:

a fixed post including a stationary transmitter for transmiting a timing signal of constant frequency which actuates said drive means;

receiving means on each of said self-propelled bodies for receiving said timing signal and transforming same into isochronous pulses;

marking means disposed at a series of reference points along said track for generating marker pulses on said self-propelled bodies at the moments the latter pass said points, thereby indicating the relative distance between said self-propelled bodies and imaginary bodies respectively associated therewith;

first counting means and second counting means on said self-propelled bodies for said isochronous pulses;

switchover means on said self-propelled bodies for alternately directing said isochronous pulses to said first counting means for determining the instantaneous positions of said imaginary bodies and to said second counting means for measuring standstill periods of said imaginary bodies; and programming means on said self-propelled bodies for actuating said switchover means when either of said counting means reaches a preselected pulse count so chosen that the associated imaginary body stops after traveling a predetermined distance from its last stopping point and then starts again after remaining stationary for a given standstill period.

14. A system as defined in claim 13 wherein each of said self-propelled bodies is provided with speedometer means and with third counting means for said marker pulses, further comprising calculating means on each of said self-propelled bodies connected to said speedometer means and to said first, second and third counting means for ascertaining said relative distance on the basis of the respective pulse counts thereof, and control means for said automatic drive means on each of said self-propelled bodies for maintaining said relative distance within limits determined by the relative magnitudes of said respective pulse counts.

15. A system as defined in claim 14 wherein said reference points are disposed with progressively decreasing separation along said track on the approach of a stopping point, said calculating means including a subtractor for determining the difference between the pulse counts of said first and third counting means, said control means causing deceleration of a self-propelled body upon a reduction of said difference below a speed-related value from said speedometer means.

16. A system as defined in claim 14 wherein said calculating means includes additive and subtractive circuitry for reducing the combined pulse counts of said first and second counting means by the pulse count of said third counting means, and circuitry for comparing the result with a predetermined threshold value and generating an alarm condition upon said result exceeding said threshold value.

17. A system as defined in claim 16 wherein each of said self-propelled bodies is provided with transmission means for signaling said alarm condition to said fixed post, the latter being provided with alarm-responsive means for inhibiting the transmission of said timing signal, thereby discontinuing said isochronous pulses at each of said self-propelled bodies.

18. A system as defined in claim 14 wherein said programming means comprises first coincidence means for comparing the pulse count of said first counting means with a first set of values representing the location of stopping points along said track, second coincidence means for comparing the pulse count of said second counting means with a second set of values representing respective standstill periods at said stopping points, and third coincidence means for comparing the pulse count of said third counting means with a third set of values corresponding to said first set for halting said self-propelled bodies at said stopping points.

19. A system as defined in claim 18 wherein said first counting means is provided with memory means transmitting the pulse count thereof to said calculating means, said memory means having a first control input connected to said first coincidence means for temporarily preserving the transmitted pulse count at a value registered upon the arrival of the associated imaginary body at a stopping point, said memory means further having a second control input connected to said third coincidence means for updating the transmitted pulse count a predetermined period after the arrival of the corresponding self-propelled body at the same stopping point.

20. A system as defined in claim 14 wherein each of said self-propelled bodies is provided with supervisory means for establishing a predetermined measuring period, odometer means generating output pulses at a rate varying with the speed of the self-propelled body, fourth counting means for said output pulses connected to said supervisory means for determining the length of track traveled during each measuring period, fifth counting means for said output pulses responsive to said marker pulses for determining the spacing between successive reference points, and comparison means connected to said fourth and fifth counting means for modifying the operation of said control means to reduce the speed of the self-propelled body upon the relative magnitudes of the pulse counts of said fourth and fifth counting means exceeding a predetermined ratio.

21. A system as defined in claim 20, further comprising supplemental reference means disposed along said track between reference points for generating additional marker pulses between normal marker pulses on said self-propelled bodies, each of said self-propelled bodies being provided with switch means controlled by said odometer means for deviating said additional marker pulses from said third counting means to said supervisory means to modify said measuring period.

22. A system for controlling the movement of a plurality of self-propelled bodies provided with automatic drive means, said bodies following one another in a predetermined order on a track, comprising:

a fixed post provided with transmitter means for sending out a timing signal to all said self-propelled bodies;

a source of marker pulses on each of said self-propelled bodies responsive to markings spacedly positioned along said track;

programming means on each of said self-propelled bodies responsive to said timing signal for determining the progress of a plurality of imaginary bodies following a simulated schedule along said track, each imaginary body being associated with a respective self-propelled body trailing same, said drive means being controlled by said programming means and by said marker pulses to keep each self-propelled body ahead of the imaginary body associated with the next-following self-propelled body;

circuit means on each of said self-propelled bodies responsive to said marker pulses and to said programming means for signaling to said post an alarm condition upon diminution of the distance between any self-propelled body and the imaginary body associated with the next-following self-propelled body below a predetermined safety margin; and monitoring means at said post responsive to said alarm condition for inhibiting the transmission of said timing signal, thereby deactivating said programming means on all said self-propelled bodies and halting the progress of all said imaginary bodies.

23. A method of controlling the movement of a plurality of self-propelled vehicles following one another in a predetermined order along a track, comprising the steps of:

programming a simulated schedule for the movement of a plurality of imaginary vehicles, each preceding an associated self-propelled vehicle, along said track;

transmitting a timing signal to all said self-propelled vehicles;

detecting aboard each self-propelled vehicle successive instants of travel past a multiplicity of stationary marks disposed along said track, thereby determining the instantaneous vehicular position;

calculating from said timing signal and from said vehicular position aboard each self-propelled vehicle the speed changes necessary to keep same behind the associated imaginary vehicle and in front of the imaginary vehicle associated with the next-following self-propelled vehicle; and driving each self-propelled vehicle in conformity with the calculated speed changes.

24. A method of controlling the movement of a plurality of self-propelled bodies following one another in a predetermined order on a track, comprising the steps of transmitting isochronous timing pulses from a fixed post to all said bodies, counting the number N of pulses received aboard each body, counting the number n of markings disposed at fixed reference points along said track, and keeping the speed of each body in a range in which the difference N-n is at least equal to a predetermined reference value calculated to maintain a safe spacing between successive bodies.

25. A method as defined in claim 24 wherein said reference value is varied in accordance with the speed of each body to provide a safe braking distance.

26. A method as defined in claim 25 wherein the emission of said timing pulses from said post is discontinued to arrest all bodies upon said difference N-n dropping below said reference value on any of said bodies.

* * * * *